US006655868B2

(12) United States Patent
Drew

(10) Patent No.: US 6,655,868 B2
(45) Date of Patent: Dec. 2, 2003

(54) BINDING DEVICE FOR HOLDING SHEET MATERIALS OR SLEEVES FOR COMPACT DISCS

(75) Inventor: Terrence M. Drew, Superior, CO (US)

(73) Assignee: Case Logic, Inc., Longmont, CO (US)

( * ) Notice: Subject to any disclaimer, the term of this patent is extended or adjusted under 35 U.S.C. 154(b) by 481 days.

(21) Appl. No.: 09/762,135

(22) PCT Filed: Dec. 27, 2000

(86) PCT No.: PCT/US00/35446

§ 371 (c)(1),
(2), (4) Date: Mar. 6, 2002

(87) PCT Pub. No.: WO01/46569

PCT Pub. Date: Jul. 12, 2001

(65) Prior Publication Data

US 2003/0161677 A1 Aug. 28, 2003

Related U.S. Application Data

(60) Provisional application No. 60/174,654, filed on Jan. 6, 2000.

(51) Int. Cl.[7] ..... B42D 3/00

(52) U.S. Cl. ..... 402/8; 24/67 R; 281/21.1; 281/27.1; 402/68; 402/73; D19/26

(58) Field of Search ..... 402/8, 14, 60, 402/68, 70, 73, 79, 80 R, 500; 281/15.1, 21.1, 27.1; 24/67 R, 67 P; D19/26, 27; 412/6, 33, 38, 39, 40

(56) References Cited

U.S. PATENT DOCUMENTS

| | | | | |
|---|---|---|---|---|
| 1,130,333 A | | 3/1915 | Plushkell | |
| 2,210,106 A | | 8/1940 | Tauber | 129/1 |
| 2,329,786 A | * | 9/1943 | Ringler | 402/8 |
| 2,422,780 A | | 6/1947 | Garrett | 281/16 |
| 2,502,493 A | | 4/1950 | Trussell | 129/1 |
| 2,612,166 A | | 9/1952 | Trussell | 129/1 |
| 3,433,688 A | * | 3/1969 | Staats et al. | 156/85 |
| 3,834,824 A | | 9/1974 | Jahn | 402/13 |
| 3,956,798 A | * | 5/1976 | Wright | 281/27.1 |
| 4,135,832 A | * | 1/1979 | Saltz | 402/15 |
| 4,437,781 A | * | 3/1984 | Weihe et al. | 402/8 |
| 4,749,427 A | | 6/1988 | Pitts et al. | 156/212 |
| 4,981,385 A | | 1/1991 | Niblock | 402/8 |
| 6,168,337 B1 | | 1/2001 | Adams | 402/8 |

* cited by examiner

*Primary Examiner*—Monica Carter
(74) *Attorney, Agent, or Firm*—Sheridan Ross P.C.

(57) ABSTRACT

A binding mechanism (2) is provided for securing compact disc sleeves and other sheet material in a notebook binder and which preferably can be quickly and selectively opened and closed.

22 Claims, 8 Drawing Sheets

FIG. 11
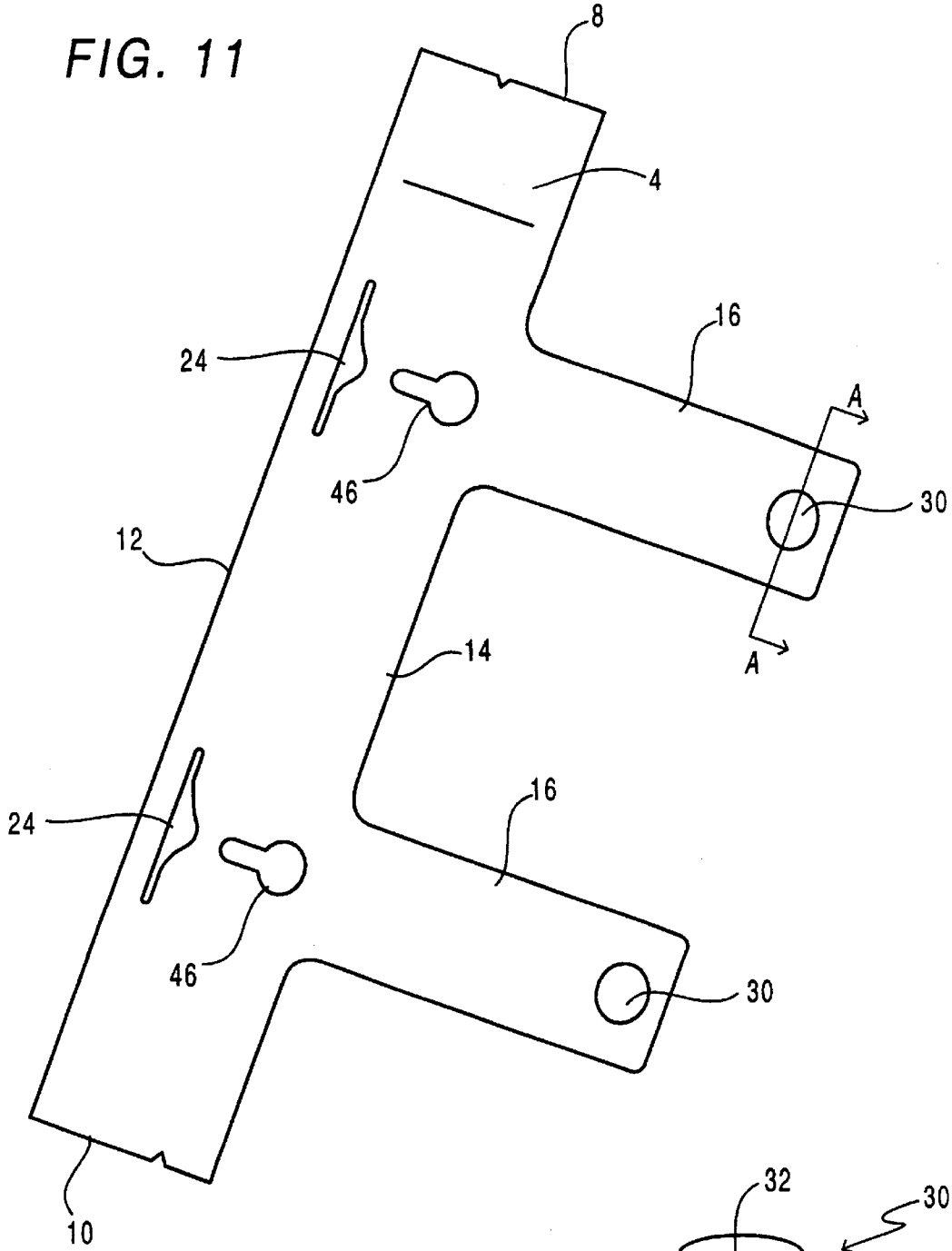
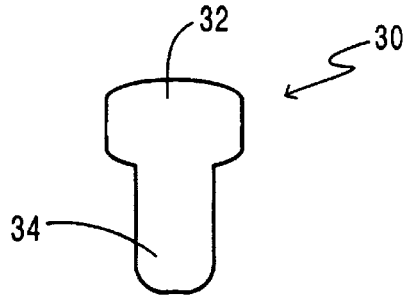
FIG. 12

BINDING DEVICE FOR HOLDING SHEET MATERIALS OR SLEEVES FOR COMPACT DISCS

This Application is a national stage of PCT/US00/35446 filed Dec. 27, 2000, which claims the benefit of Provisional application Ser. No. 60/174,654 filed Jan. 6, 2000.

The present invention relates to mechanisms for holding flat sheet materials in a binding device such as a notebook or wallet, and more specifically sheet materials such as sleeves which hold compact discs and other similar recording discs.

BACKGROUND OF THE INVENTION

Binding devices such as notebooks are commonly used for holding flat sheet materials such as paper sheets in a protective covering. Most commonly, 3-ring binders are often used which typically provide three rigid, circular metallic rings which selectively snap open to insert or remove sheet materials, and are then locked in a closed position to prevent the sheet materials from inadvertently falling from the binding device. Unfortunately, these type of binding devices are rigid, and not suitable for use in more flexible notebooks. Additionally, the metallic rings are prone to being bent and thus allowing the sheet materials to inadvertently fall from the binding device, or tear after repeated use.

Additionally, typical 3-ring binding devices are typically comprised of metallic materials which are expensive to manufacture and sell. These types of binding devices can additionally rust and typically require a very rigid backing plate mechanism and associated notebook to provide sufficient support.

Thus, there is a need for a cost effective binding mechanism which can be used in a flexible type notebook or wallet storage containers and which allows flexible sheet materials such as compact disc sleeves to be selectively removed from within the flexible binding device without being obstructed or damaged during use. Additionally, there is a significant need for a binding device which is flexible, and thus suitable for use in compact disk wallets and other similar devices which are non-rigid and conformable for a variety of different applications.

SUMMARY OF THE INVENTION

It is thus an object of the present invention to provide a flexible binding device which can be used to selectively insert and remove sheet materials in a notebook type device. Alternatively, the binding device may be designed in a manner which would not allow the removal of the sheet materials once they are inserted and secured within the binding device. Preferably, the binding mechanism can be used without tools, and is simplistic in design to quickly allow the insertion and removal of sheet materials, yet provides a secure, failproof system which prevents the sheet materials from inadvertently falling from the notebook. The sheet materials may be paper writing sheets, but more typically are sleeves such as flexible polyethylene sheets capable of holding a plurality of compact discs (CDs), Digital Video Discs (DVDs), CD Roms or other similar type of recording disc (hereinafter "CDs") in one or more pockets. Typically the graphics associated with the CDs are also stored in a pocket positioned on an opposite side of the same sleeve.

It is a further object of the present invention to provide a flexible binding device which does not use metallic components, is cost effective to manufacture and is made of a resilient material which is flexible and can be used in a flexible yet durable wallet or notebook. Thus, in one embodiment of the present invention, a binding device is provided which is adapted for holding sheet materials in a notebook and comprises:

- a substantially planar top plate interconnected to a substantially planar bottom plate, said top plate comprising a top edge, a bottom edge, a left lateral edge and a right lateral edge extending therebetween;
- at least one strap extending from said right lateral edge of said top plate and having a first end and a second end;
- a window aperture positioned near said first end of said at least one strap;
- a strap slit operably positioned in said top plate opposite said strap and sized to receive said first end of said at least one strap;
- a latch tab positioned on said substantially planar top plate between said strap slit and said second end of said at least one strap and deflectable to extend downward toward said bottom plate; and
- a cutout portion in said bottom plate which operatively receives said latch tab, wherein when said first end of said at least one strap is inserted through said strap slit said window aperture engages said latch tab, wherein said at least one strap is operably secured to said latch tab to create a loop adapted to hold the sheet materials in the notebook.

BRIEF DESCRIPTION OF THE DRAWINGS

FIG. 11 is the top plate of an alternative embodiment of the invention shown in FIG. 9; and FIG. 12 is a front elevation view taken from Section A—A of the notebook binding mechanism shown in FIG. 11.

DETAILED DESCRIPTION

Figure 1:
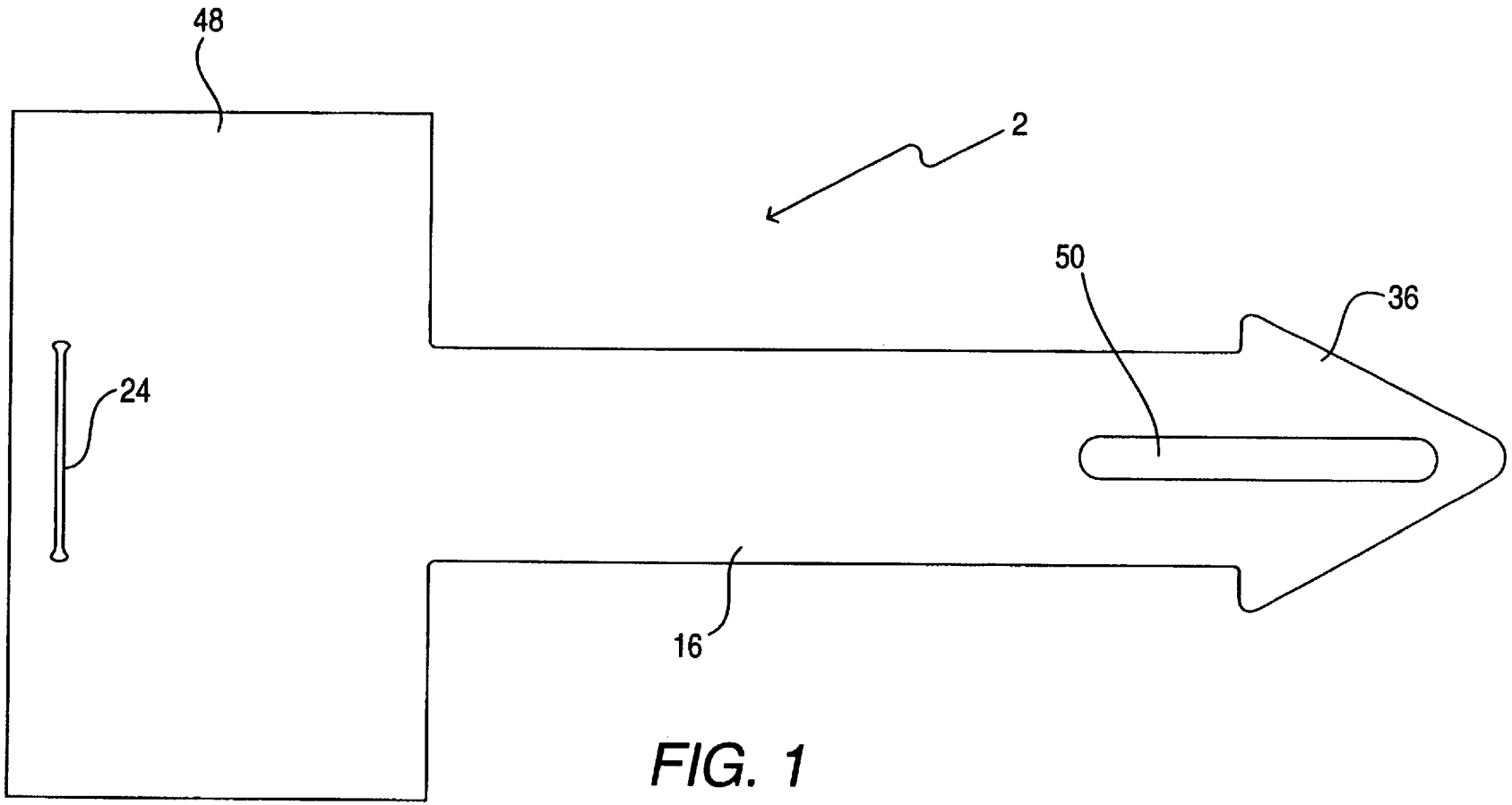
FIG. 1 is a top plan view of a notebook sheet binding mechanism with an arrowhead shaped latching mechanism.

Referring now to FIG. 1, in one embodiment of the present invention a flexible head portion 36 is used in conjunction with a strap 16, and a strap slit 24 which is positioned in the spine 48 of the binding device 2 to provide removable interconnection to a plurality of sheet materials. More specifically, the flexible head 36 is inserted through a slot provided in the sheet materials and then wrapped around and inserted in the strap slit 24 positioned in the spine 48 of the notebook binding device.

In one embodiment, the head 36 has an arrow shape to help facilitate insertion and removal of the head 36 into the strap slit 24. The flexible arrow shaped head 36 is resilient and deformable enough to allow sufficient bending to allow the head portion to be inserted into the strap slit 24. Once the arrow shaped head 36 is inserted into the strap slit 24, the back portion of the head 36 expands and thus prevents the arrow shaped head 36 from inadvertently becoming disengaged from the strap slit 24 until finger pressure is applied to the flexible strap 16 directly behind the flexible arrow shaped head 24. With sufficient finger pressure, the flexible arrow shaped head can be withdrawn from the engagement slot to remove or add additional sheet materials. As further seen in FIG. 1, a cut-out portion 50 may also be provided in a preferred embodiment which allows the arrow shaped head 36 to deflect sufficiently to permit insertion into the strap slit 24. As appreciated by one skilled in the art, other shapes may be used such as squares, rectangles, etc. As opposed to the arrowhead shape and which functionally engages the strip slit 24 to prevent inadvertent disengagement.

Figure 2:
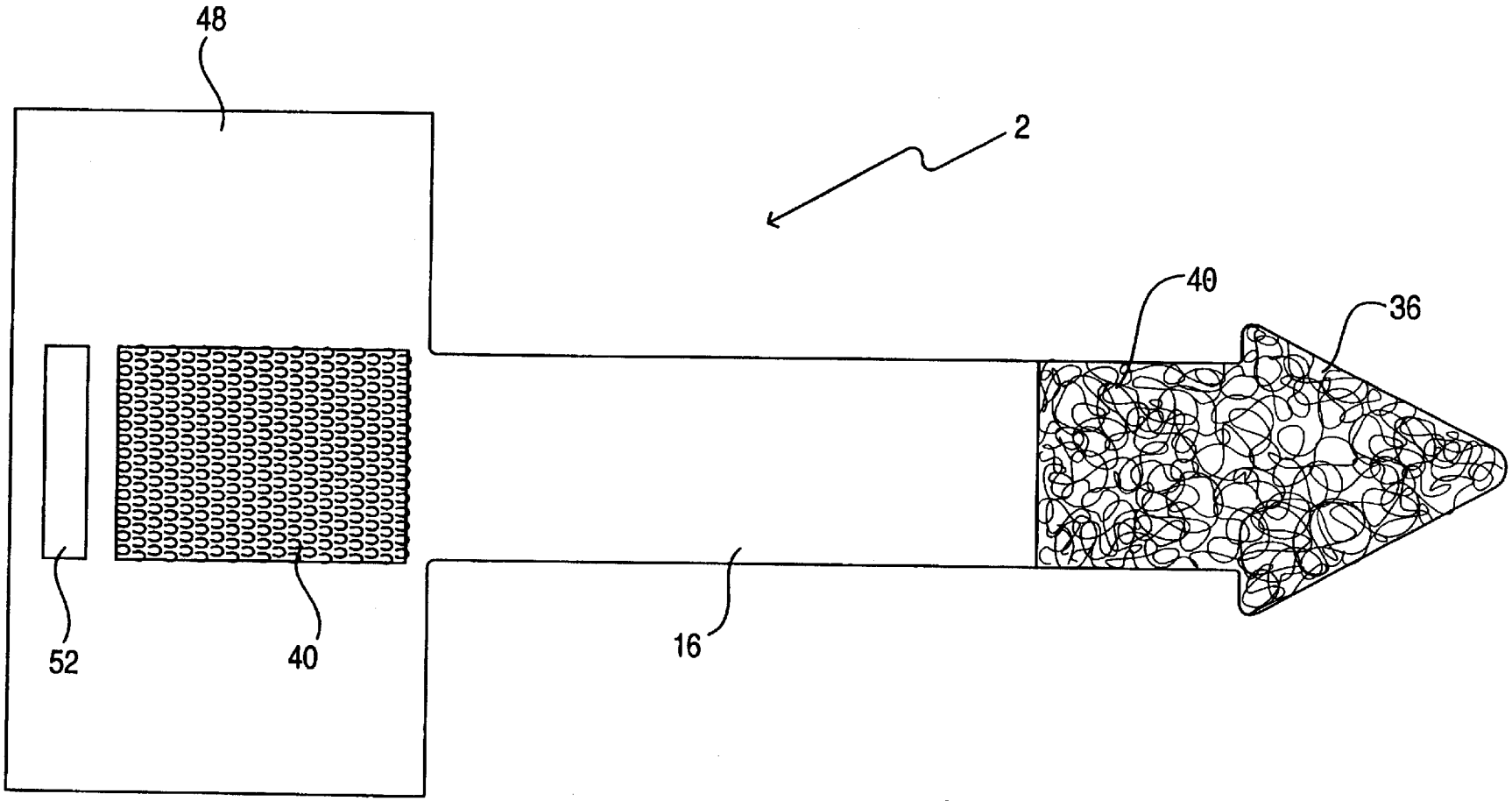
FIG. 2 is a top plan view of a notebook sheet binding mechanism and further utilizing a hook and loop material for interconnection purposes.

In an alternative embodiment of the present invention seen in FIG. 2, a plurality of hook and loop type materials such as Velcro® may be provided in conjunction with the flexible arrow shaped head 36. More specifically, the hook and loop materials 40 may be provided on the arrow shaped head 36 portion of the flexible plastic strap 16, and additionally positioned proximate to a buckle or loop 52 located on the spine 48 of the notebook. After the flexible arrow shaped head 36 is inserted through one or more flexible sheet materials, the arrow shaped head is drawn through a buckle or loop 52 and then positioned on the hook and loop material 40 which is positioned proximate to the buckle or loop 52. Thus, the flexible arrow shaped head portion 36 becomes engaged with the hook and loop material 40 as well as being positioned through the buckle or loop to provide a secure but releasable engagement mechanism.

Figure 3:
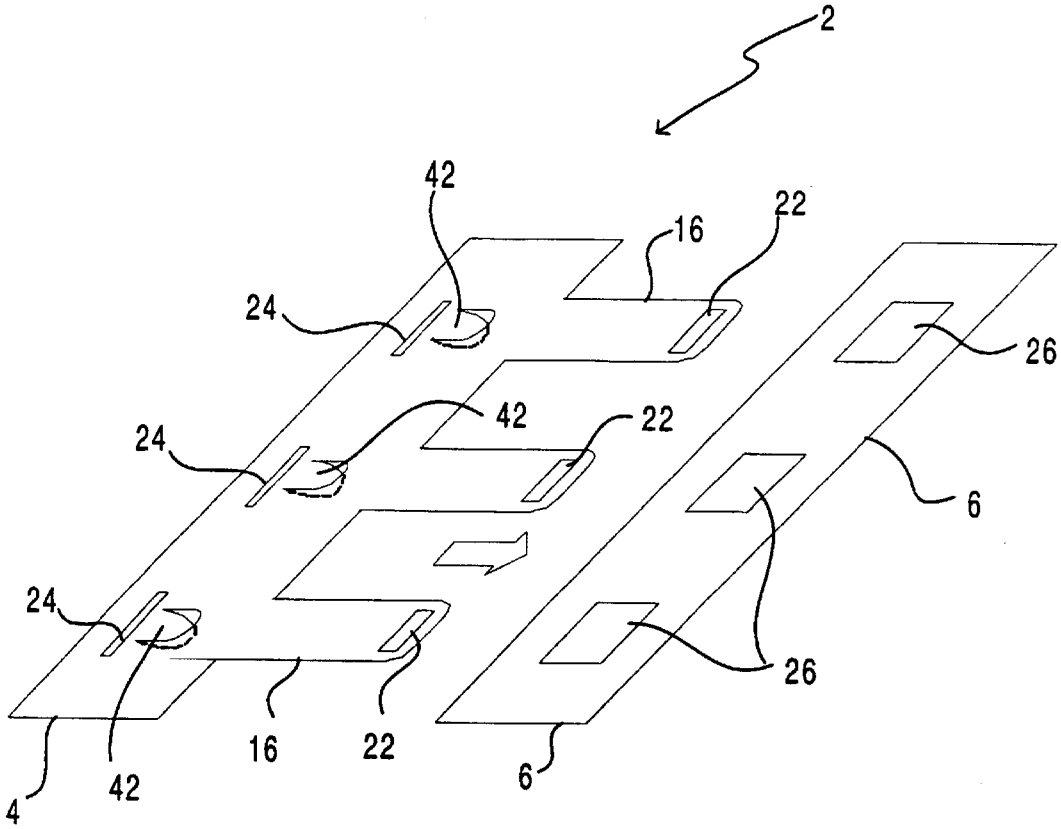
FIG. 3 is a front perspective view of an alternative embodiment of the present invention and identifying a top plate with interconnected straps and a bottom plate for positioning below the top plate.

Referring now to FIGS. 3–8, an alternative embodiment of the present invention is provided. Referring now to FIG. 3, the assembly of a notebook binding device 2 utilizing one or more window straps and associated locking mechanisms are provided herein. More specifically, the binding mechanism 2 comprises a top plate 4 and a bottom plate 6 which are positionally interconnected. The top plate 4 is comprised of a spine 48 which has one or more straps 16 extending therefrom. On the end of each of the straps a window aperture 22 is positioned for locking engagement to a latch tab 26 which is created by a cut-out portion provided on the bottom plate 6. Additionally positioned on the top spine 48 are strap slits 24 which are sized to operatively receive the straps 16. Further, a cutout is provided in the top spine 48 between the strap slits 24 and the straps 16, with guide tabs 42 which are bent downward for engaging the bottom plate 6. The guide tabs are generally used during interconnection to guide the window aperture 22 to the latch tabs 26.

The bottom plate 6 is generally comprised of a spine 48, having one or more latch tabs 26 extending upwardly as a result of cuts made in the bottom spine. The top plate 4 and the bottom plate 6 are generally interconnected along the edges by stitching, heat welding or other interconnection means commonly known in the art. As seen in FIG. 3, when the top plate 4 is positioned on top of the bottom plate 8, the guide tab 42 of the top plate spine 48 extends through the spine 48 on the bottom plate 6 at a cutout portion provided by the latch tab 26.

Figure 4:
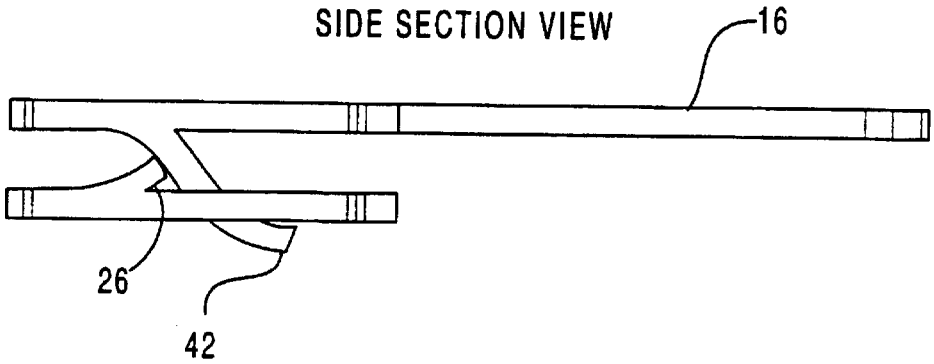
FIG. 4 is a front elevation sectional view of the notebook binding mechanism shown in FIG. 3 and showing the interconnection of the top plate and the bottom plate.
Figure 5:
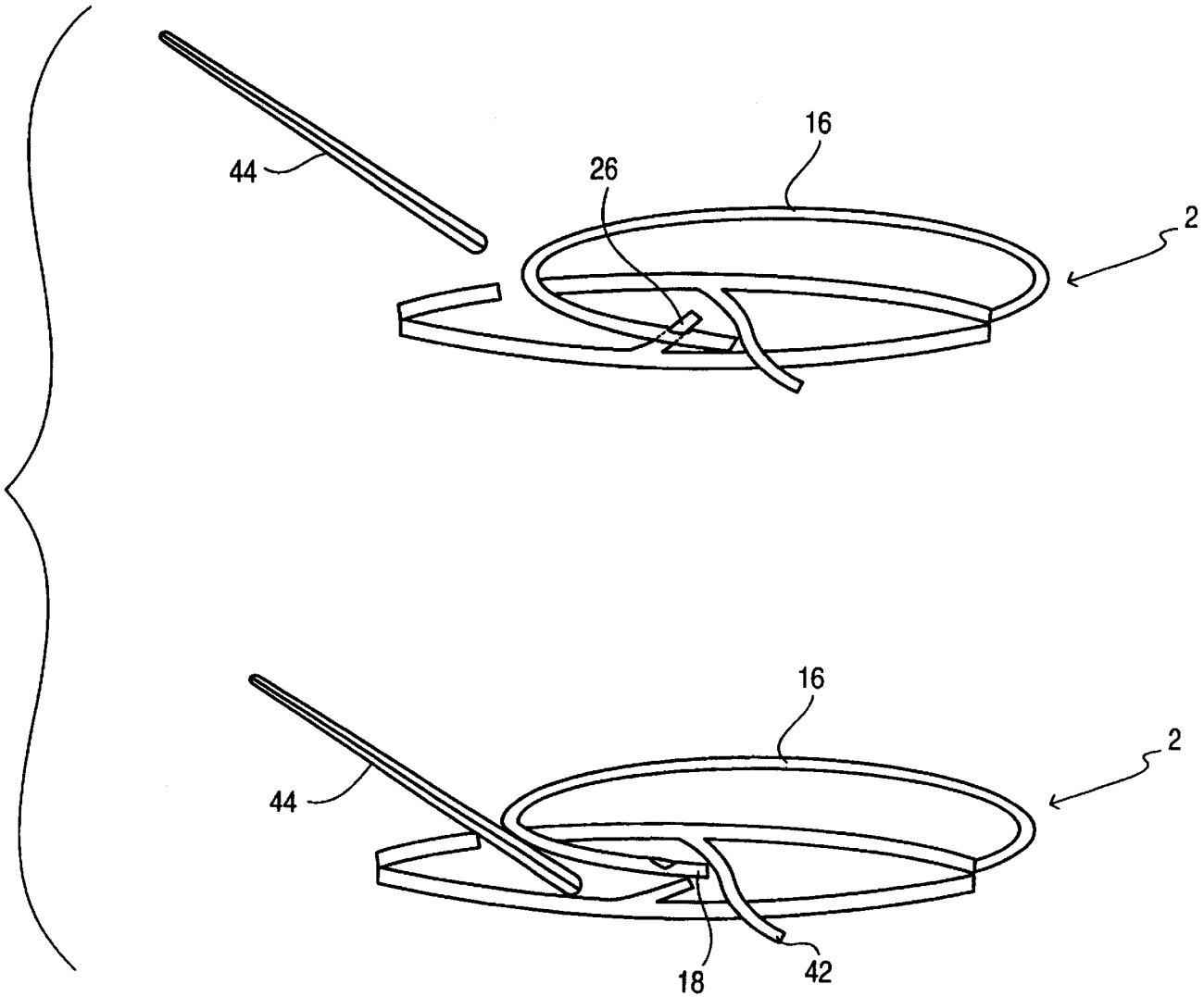
FIG. 5 is a front elevation view of the notebook binding mechanism shown in FIG. 3 in an interconnected and locked position and further identifying the use of a removal tool for disengaging the strap from the bottom plate.

Referring now to FIG. 4, the latching detail of the present invention is shown in greater detail in a front elevation sectional view. More specifically, once a strap 16 is positioned through the flat sheet material (not shown), the end of the strap is wrapped around and inserted through the strap slits 24. Once the end of the strap 16 is positioned through the strap slit 24 it is pushed downward until the window aperture 22 engages the latch tab 26 and interconnects thereto. This provides a secure locking mechanism which prevents the first end 18 of the straps 16 from being disengaged from the latch tabs 26 until additional sheet materials are desired to be inserted or removed from the flexible notebook. As seen in FIG. 5, the guide tab additionally serves the purpose of guiding the window end of the strap downward as it is inserted through the strap slit 24 to allow the window aperture 22 to engage the latch tab 26.

Referring now to FIG. 5, a drawing showing the strap 16 being disengaged from the latch tab 26 is provided herein. It should be pointed out that although a strap removal tool 44 is shown in this embodiment, it is generally not necessary to use a removal tool 44 to release the strap 16 from the latch tab 26 for disengagement from the bottom plate 6. Rather, mere finger pressure can be used to accomplish the same purpose. As seen in FIG. 5, to disengage the strap from the latch tab, the tool 44 is inserted through the strap slit 24 and positioned below the strap 16. As upward pressure is then provided to the strap 16, the window aperture 22 is disengaged from the latch tab 26. The strap 16 may then be pulled in a rearward position from the latch tab 26 and allowing the strap 16 to be removed from the strap slit 24. The guide tab 42 is positioned to engage the forward end of the strap 16 to help guide the removal of the strap 16 as it is withdrawn through the strap slit 24.

Figure 6:
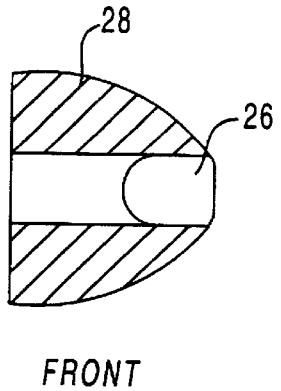
FIG. 6 is a top plan view of the latching mechanism of the bottom plate of the notebook binding mechanism shown in FIG. 3.
Figure 7:
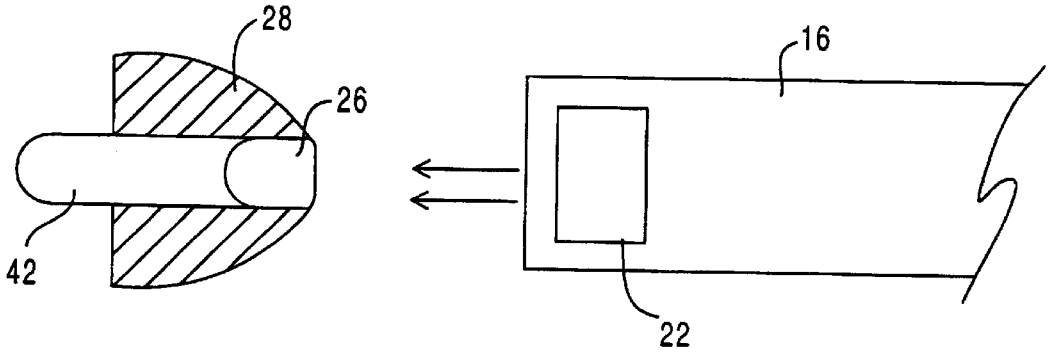
FIG. 7 is a top plan view of the latching components of the notebook binding mechanism shown in FIG. 3.
Figure 8:
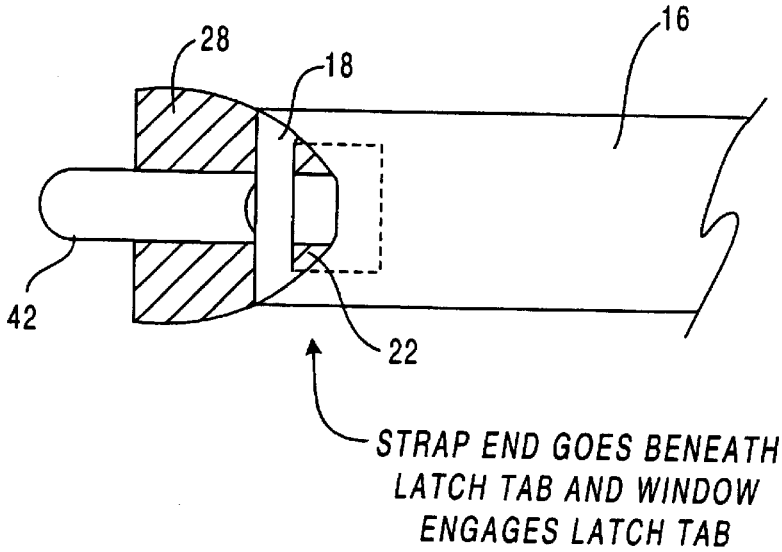
FIG. 8 is a top plan view identifying the interconnection of the window aperture and latch tab of the binding mechanism shown in FIG. 3.

Referring now to FIGS. 6–8, a top plan view is provided of the bottom plate which identifies the latch tab 26, guide tab 42, strap 16 and window aperture 22 and showing additional detail with regard to the engagement therein. More specifically, FIG. 6 identifies the main component of the binding mechanism and showing the latch tab 26 positioned in the cut-out portion 28 and just prior to insertion of the guide tabs 42 and/or the interconnection to the strap 16 and the window aperture 22. FIG. 7 shows the cutout 28 in the bottom plate with the guide tab 42 being inserted therethrough and showing the latch tab 26 extending into the cutout portion and in position for receiving the window aperture 22 of the strap 16.

Referring now to FIG. 8, the strap 16 is shown interconnected to the latch tab 26 by means of the window aperture 22. This is accomplished by inserting the strap 16 through the strap slits 24, and engaging the latch tab 26 within the cutout 28 in the bottom plate. Thus, when tension is provided to the strap 16, it is prevented from being disengaged from the binding mechanism 2 as result of being interconnected to the latch tab 26. Again, the guide tab 42 serves the purpose of guiding the first end 18 of the strap 16 with the associated window aperture 22 into a position for engagement with the latch tab 26. Again, to remove the strap 16 from the binding mechanism, the strap is merely pushed in a direction toward the guide tab, thus disengaging the window aperture 22 from the latch tab 26. At this point the strap 16 can be removed from the binding device 2 and additional sheet materials or compact disc sleeves can be inserted or removed as necessary from the notebook or wallet.

Figure 9:
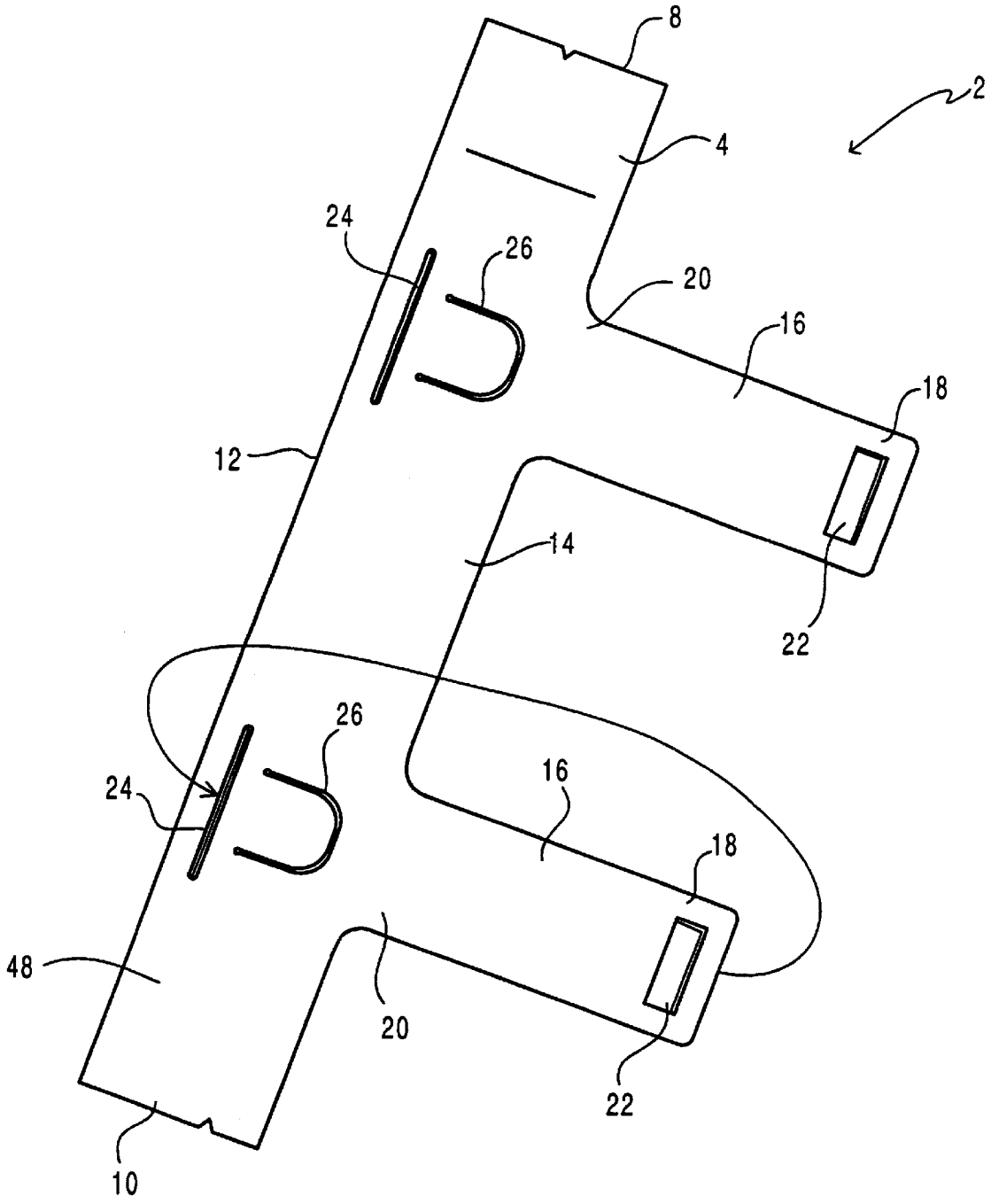
FIG. 9 is a top plan view of the top plate of an alternative embodiment of the notebook binding mechanism.

Referring now to FIGS. 9–12, a preferred embodiment of the present invention is shown in greater detail. More specifically, and referring now to FIG. 9, a top plan view is provided of the top plate 4 used in the present invention. The top plate 4 more specifically comprises a top edge 8, a bottom edge 10, a left lateral edge 12 and a right lateral edge 14 which defines a spine 48. The top plate 4 additionally includes one or more straps 16 extending therefrom and as shown in FIG. 9 extending from the right lateral edge 14. The strap has a first end 18 and is interconnected on a second end 20 to the right lateral edge 14 of the spine 48. The strap first end 18 additionally comprises a window aperture 22 which in this particular embodiment has a substantially rectangular shape. As appreciated by one skilled in the art, the window aperture 22 may have a square, circular, triangular or any other type of geometric configuration which facilities interconnecting and latching to the latch tab 26 as further described herein.

As additionally seen in FIG. 9, a latch tab 26 is provided which is substantially an arcuate shaped cutout in the spine 48 portion of the top plate 4. The latch tab 26 is operatively positioned between a strap slit 24 and the strap second end 20. The strap slit 24 generally is an aperture having a width and height of sufficient dimension to receive the strap first end 18.

Figure 10:
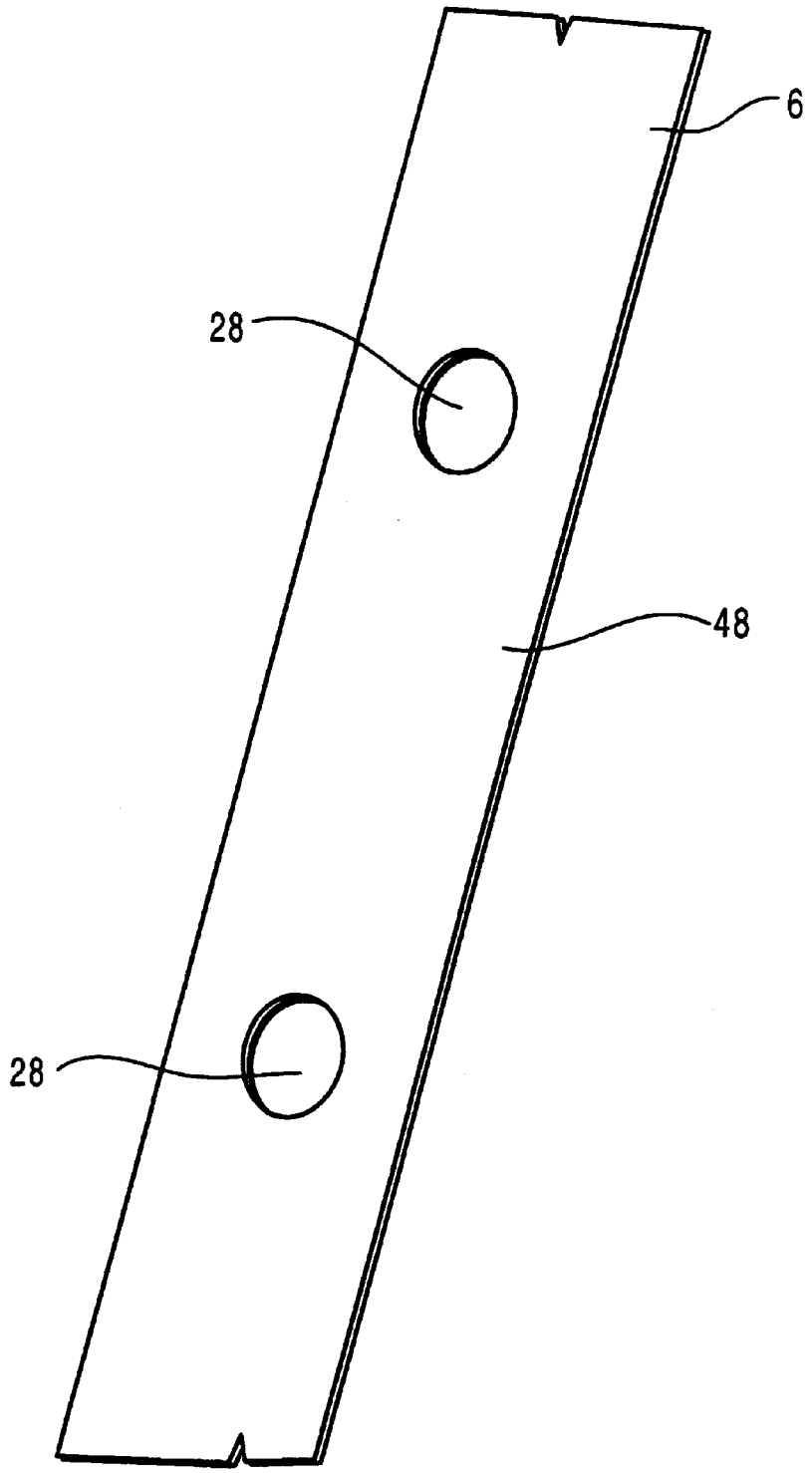
FIG. 10 is the bottom plate used in combination with the top plate of the notebook binding mechanism shown in FIG. 9.

Referring now to FIG. 10, the bottom plate 6 of the strap binding mechanism 2 utilized with the top plate 4 shown in FIG. 9 is provided herein. The bottom plate 6 is generally comprised of a substantially rectangular shaped spine 48 which in a preferred embodiment is substantially the same dimension as the top plate 4. Additionally positioned in the bottom plate 6 are bottom plate cutout 28 portions which are positioned to oppose the latch tabs 26 shown in the top plate 4.

In use, the top plate 4 is operatively positioned on top of the bottom plate 6. The first end of the strap first end 16 is then positioned through a opening or slit in one or a plurality of sheet material such as sleeves used to hold compact discs. After the strap first end 18 is positioned through the sheet materials, the strap first end 18 is inserted through the strap slit 24 until the window aperture 22 engages the latch tab 26. The latch tab 26 is resiliently pushed downwardly into bottom plate 6 by use of the bottom plate cutout 28. Thus, the window aperture 22 engages the latch tab 26 and prevents the strap 16 from being released from the latch tab 26 of the top plate 4. As appreciated by one skilled in the art, the latch 26 may additionally have different geometric shapes, including a triangle, rectangle, circular or half-moon shape or any other embodiment which is capable of engaging and interlocking the window aperture 22 of the strap 16.

Referring now to FIG. 11, an alternative embodiment of the invention in FIG. 9 is proved herein. More specifically, a stud 32 is provided and interconnected to the first end of the strap first end 18 of the strap 16, as opposed to the use of a window aperture as shown in FIG. 9. The stud 30 is generally comprised of a stud head 32 and a stud shaft 34 and is integrally interconnected to the strap first end 18. In use, the stud 30 is inserted through the strap slit 24 after being inserted through one or plurality of sheet materials. As the stud is pushed through the strap slit 24, the stud head 32 engages the opening of the stud receiving slot 46. As the strap 16 is pulled rearward and toward the left lateral edge 12 of the spine, the stud shaft 34 slidably engages the stud receiving slot 46 and the stud head 32 having a larger dimension then the stud shaft 34 is prevented from being disengaged from the stud receiving slot 46. To disengage the strap first end 18 from the stud receiving slot 46, the stud head 32 is pushed in a direction toward the right lateral edge 14 of the top plate 4. When the stud head 32 reaches the larger circular aperture of the stud receiving slot 46, the stud head 32 is allowed to become disengaged from the stud receiving slot 46. FIG. 12 is merely a front elevation view of the associated stud head 32 and stud shaft 34 as taken from Section A—A of FIG. 11. As appreciated by one skilled in art, in this particular embodiment it may or may not be necessary to include a bottom plate 6 as shown in the embodiment of FIG. 9. It should additionally be appreciated that the bottom plate 6 in FIG. 9 is preferred, but not necessarily required based on the flexibility of the latch tab 26 and associated top plate 4.

For clarity purposes, the following list of components and numbering associated with the present invention and drawings are provided herein as follows:

2 Binding Device
4 Top Plate
6 Bottom Plate
8 Top Edge
10 Bottom Edge
12 Left Lateral Edge
14 Right Lateral Edge
16 Strap
18 Strap First End
20 Strap Second End
22 Window Aperture
24 Strap Slit
26 Latch Tab
28 Bottom Plate Cutout
30 Stud
32 Stud Head
34 Stud Shaft
36 Strap Head
38 Loop
40 Hook or Loop Material
42 Guide Tab
44 Strap Removal Tool
46 Stud Receiving Slot
48 Spine
50 Strap Head Cutout
52 Loop The foregoing description of the present invention has been presented for purposes of illustration and description and is not intended to limit the invention of the form disclosed herein. Consequently, variations and modifications commensurate with the above teaching and skill and knowledge of the relevant art are within the scope of the present invention. The embodiments described herein above are further intended to explain best modes of practicing the invention and to enable others skilled in the art to utilize the invention and such or other embodiments with various modifications required by the particular application or use of the present invention. It is intended that the appended claims be construed to include alternative embodiments to the extent permitted by the prior art.

What is claimed is:

1. A binding mechanism adapted for holding sheet materials in a notebook comprising:

a substantially planar top plate interconnected to a substantially planar bottom plate, said top plate comprising:

a top edge, a bottom edge, a left lateral edge and a right lateral edge extending therebetween;

at least one strap extending from said right lateral edge of said top plate and having a first end and a second end;

a window aperture positioned near said first end of said at least one strap;

a strap slit operably positioned in said top plate opposite said strap and sized to receive said first end of said at least one strap;

a latch tab positioned on said substantially planar top plate between said strap slit and said second end of said at least one strap and deflectable to extend downward toward said bottom plate; and a cutout portion in said bottom plate which operatively receives said latch tab, wherein when said first end of said at least one strap is inserted through said strap slit said window aperture engages said latch tab, wherein said at least one strap is operably secured to said latch tab to create a loop adapted to hold the sheet materials in the notebook.

2. The binding mechanism of claim 1, wherein said sheet materials contain at least one sleeve adapted for holding a compact disc.

3. The binding mechanism of claim 1, wherein said top plate, said bottom plate, and said at least one strap are comprised of a flexible plastic material.

4. The binding mechanism of claim 1, wherein said window aperture is rectangular in shape.

5. The binding mechanism of claim 1, wherein said window aperture is circular in shape.

6. The binding mechanism of claim 1, wherein said latch tab has a semi-circular shape.

7. The binding mechanism of claim 1, wherein said latch tab may be deflected downwardly with finger pressure.

8. The binding mechanism of claim 1, wherein said latch tab has a rectangular shape.

9. The binding mechanism of claim 1, wherein there are at least two substantially identical straps extending at right angles from said substantially planar top plate.

10. A method for selectively securing sheet materials in a notebook binding device, comprising the steps of:

providing a substantially planar top plate positionally interconnected to a substantially planar bottom plate, said top plate comprising at least one strap extending therefrom having a first end and a second end, said second end interconnected to said substantially planar top plate;

providing a window aperture positioned near said first end of said at least one strap;

providing a strap slit operably positioned in said top plate substantially opposite said strap and sized to receive said first end of said at least one strap;

providing a latch tab positioned on said top plate between said strap slit and said at least one strap and deflectable to extend downward toward said bottom plate; and providing a cutout portion in said bottom plate which operatively receives said latch tab when said latch tab is deflected downward; and guiding said first end of said at least one strap through a slit aperture positioned along a lateral edge of the sheet material;

inserting said first end of said at least one strap through said strap slit positioned in said substantially planar top plate;

engaging said guide tab with said window aperture, wherein said window aperture becomes releasably interconnected to said guide tab to secure the sheet materials in the notebook binding device.

11. The method of claim 10, further comprising the step of pushing the first end of the at least one strap away from said strap slit to disengage the window aperture from said latch tab, wherein said first end of said at least one strap is released from said latch tab.

12. The method of claim 11, further comprising the step of inserting a tool between said top plate and said bottom plate to disengage the window aperture from said latch tab.

13. The method of claim 10, further comprising the step of interconnecting at least said substantially planar bottom plate to said notebook binding device.

14. The method of claim 10, further comprising the step of pulling said first end of said strap toward said strap slit after engaging said latch tab, wherein said latch tab deflects downward and prevents said first end of said at least one strap from inadvertently becoming disconnected from said latch tab.

15. A binding apparatus adapted for securing sheet materials in a flexible wallet, comprising:

a substantially planar top plate having a top edge, a bottom edge, a left lateral edge and a right lateral edge;

at least one strap interconnected on a second end to said right lateral edge of said substantially planar top plate;

a strap aperture positioned on a first end of said at least one strap;

a strap slot aperture positioned proximate to a said left edge of said substantially planar top plate and positioned substantially opposite said at least one strap;

a latch tab positioned between said strap slit and said second end of said at least one strap and deflectable downward, wherein when said first end of said at least one strap is inserted through said strap slit said strap aperture is positioned to engage said latch tab, wherein said at least one strap is secured to said latch tab.

16. The binding apparatus of claim 15, further comprising a substantially planar bottom plate interconnected to a lower surface of said substantially planar top plate and comprising an aperture positioned opposite said latch tab to allow said latch tab to deflect downwardly.

17. The binding apparatus of claim 15, wherein said binding apparatus is interconnected to a spine of said compact disc wallet.

18. The binding apparatus of claim 15, wherein said substantially planar top plate, and said at least one strap are comprised of a plastic material.

19. The binding apparatus of claim 15, wherein said latch tab is deflectable downward when finger pressure is applied thereto.

20. The binding apparatus of claim 15, wherein said latch tab has an arcuate shape.

21. A binding apparatus adapted for securing sheet materials in a notebook, comprising:

a substantially planar top plate having a top edge, a bottom edge, a left lateral edge and a right lateral edge;

a substantially planar bottom plate positioned below said top plate;

at least one strap having a first end and a second end, said second end interconnected to said right lateral edge of said substantially planar top plate;

a substantially planar bottom plate interconnected to a lower surface of said substantially planar top plate and comprising an aperture positioned opposite said slot aperture to allow clearance of said stud;

a stud interconnected to said at least one strap proximate to said first end and extending outwardly therefrom, said stud having a head with a first diameter and a shaft interconnected to said head with a second diameter which is less than said first diameter;

a strap slit positioned proximate to said left edge of said substantially planar top plate and opposite said at least one strap; and a latch aperture positioned between said slot aperture and said second end of said at least one strap and sized to receive said stud in locking engagement.

22. The binding apparatus of claim 20, wherein said latch aperture has a first diameter on a first end at least as big as said first diameter of said stud head and a second diameter on a second end which is less than said first diameter of said stud head, wherein when said stud is engaged with said second diameter of said latch aperture, said at least one strap is lockingly engaged thereto.

* * * * *